US006306066B1

(12) United States Patent
Yang

(10) Patent No.: US 6,306,066 B1
(45) Date of Patent: Oct. 23, 2001

(54) SAFETY-CONTROL DEVICE OF HEIGHT ADJUSTMENT FOR A BABY WALKER

(76) Inventor: Peng-Yao Yang, No. 561, Section 4, An Ho Road, Tainan (TW)

( * ) Notice: Subject to any disclaimer, the term of this patent is extended or adjusted under 35 U.S.C. 154(b) by 0 days.

(21) Appl. No.: 09/597,721

(22) Filed: Jun. 19, 2000

(51) Int. Cl.[7] ..... A62B 7/06; A47D 13/04

(52) U.S. Cl. ..... 482/68; 247/5; 280/647; 280/649

(58) Field of Search ..... 482/68, 148, 51; 297/136, 56, 49, 340, 344.12, 344.13, 344.15, 5; 280/644, 647, 85.051

(56) References Cited

U.S. PATENT DOCUMENTS

| | | | | |
|---|---|---|---|---|
| 4,759,541 | * | 7/1988 | Chen | 482/68 |
| 5,324,064 | * | 6/1994 | Sumser et al. | 280/649 |
| 5,351,978 | * | 10/1994 | Chen | 280/87.051 |
| 5,447,319 | * | 9/1995 | Huang | 280/87.051 |
| 5,820,527 | * | 10/1998 | Lai | 482/68 |

* cited by examiner

*Primary Examiner*—Stephen R. Crow
(74) *Attorney, Agent, or Firm*—Rosenberg, Klein & Lee

(57) ABSTRACT

A safety-control device of height adjustment for a baby walker includes two opposite planks, a main body and a pressing board. The main body is provided with a lateral opening in the front wall for receiving an elastic article and a stopping button. In the top of the main body is provided with an upper room for the elastic article and the stopping button and an operating block to be placed in. The lower section of the operating block is placed in the hollow of the stopping button, and a fixing pin is used to penetrate through the passing holes of the main body and the long hole of the operating block so as to make the operating block be pivotally assembled with the main body. The operating block can be operated by one finger to make the stopping button be withdrawn inward for the pressing board to be moved by another finger at the same time so as for the pressing board and the main body as well as the supporting skeleton being shifted together to choose one of the ratchets on the two planks provided in the bottom of the upper plate for the catch portion to catch and fix. When the operating block being released, the stopping button will protrude outward by the elasticity of the elastic article to stop against the pressing board again.

1 Claim, 7 Drawing Sheets

SAFETY-CONTROL DEVICE OF HEIGHT ADJUSTMENT FOR A BABY WALKER

BACKGROUND OF THE INVENTION

1. Field of the Invention

This invention relates to a safety-control device of height adjustment for a baby walker, more particularly to a safety-control device which can be conveniently operated by one hand to adjust the height and fix the position of the upper plate of a baby walker so as to prevent a baby in the baby walker from being hurt by the rapid fall of the upper plate.

2. Description of the Related Arts

Referring to FIG. 1, a baby walker is generally composed by a base frame 10, a supporting skeleton 20 and an upper plate 30. The height of the upper plate 30 can be adjusted according to the height of a baby carried in the baby walker. A conventional height-adjusting device for a baby walker is disposed between the bottom of the upper plate 30 and the supporting skeleton 20. The conventional height-adjusting device includes a positioning board 40, a slidable retaining member 50 and a pressing board 60.

Referring to FIGS. 2 and 3, the positioning board 40 is provided to secure to the bottom of the upper plate 30. The positioning board 40 is integrately made of plastic, and a reinforce board 401 is provided on the top surface of the positioning board 40 to add intensity. In both ends of the positioning board 40 are respectively provided with long holes 402 for screws to penetrate through so as to secure the positioning board 40 to the bottom of the upper plate 30. Several hollow blocks 403 are provided in equal distances on the reinforce board 401. In the top surface of each hollow block 403 is provided with a passing hole 404 for a screw 405 to penetrate through to screw each hollow block 403 to the bottom of the upper plate 30 so as to make the positioning board 40 be firmly secured to the bottom of the upper plate 30, as shown in FIG. 3. On the top surface of each hollow block 403 and in accordance with each passing hole 404 is provided with an annulus 406 so as to make each screw 405 be firmly screwed to the bottom of the upper plate 30 by the close attachment of each annulus 406. A slant surface 407 is provided on one side of each hollow block 403.

The slidable retaining member 50 is provided to mount on the supporting skeleton 20, and the pressing board 60 is pivotally provided on the slidable retaining member 50. When the pressing board 60 being pressed, the slidable retaining member 50 can be released to choose any one of the hollow blocks 403 to adjust the height of the supporting skeleton 20 as well as the upper plate 30. After the pressing board 60 being released, the slidable retaining member 50 will be caught and fixed in the chosen hollow block 403. When the pressing board 60 being pressed again, the slidable retaining member 50 can move out the hollow block 403 from the slant surface 407 to choose another hollow block 403 to be caught in so as to adjust the height of the supporting skeleton 20 as well as the upper plate 30.

Although the height of the baby walker with the above-mentioned conventional height-adjusting device can be easily adjusted, it is easy for the baby carried in the walker or another baby to happen to press the pressing board 60 to make the slidable retaining member 50 depart from one of the hollow blocks 403 and loose the function of fixing. Consequently, the upper plate 30 will fall down rapidly, the baby in the baby walker will be frightened and even hurt.

SUMMARY OF THE INVENTION

In view of the drawback of the prior art mentioned above, an objective of this invention is to provide a safety-control device of height adjustment for a baby walker which can be easily operated by one hand to adjust the height and fix the position of the upper plate of the baby walker so as to prevent a baby from being frightened and hurt by the rapid fall of the upper plate.

Accordingly, a safety-control device of height adjustment for a baby walker in the present invention includes two opposite planks, a main body and a pressing board. The main body is provided with a lateral opening in the front wall for receiving an elastic article and a stopping button. In the top of the main body is provided with an upper room for the elastic article and the stopping button and an operating block to be placed in. The lower section of the operating block is placed in the hollow of the stopping button, and a fixing pin is used to penetrate through the passing holes of the main body and the long hole of the operating block so as to make the operating block be pivotally assembled with the main body. The operating block can be operated by one finger to make the stopping button be withdrawn inward for the pressing board to be moved by another finger at the same time so as for the pressing board and the main body as well as the supporting skeleton being shifted together to choose one of the ratchets on the two planks provided in the bottom of the upper plate for the catch portion to catch and fix. When the operating block being released, the stopping button will protrude outward by the elasticity of the elastic article to stop against the pressing board again. Thus, the safety-control device can adjust the height and fix the position of the upper plate so as to prevent the upper plate from rapidly falling down by the accident press of the pressing board.

BRIEF DESCRIPTION OF THE DRAWINGS

Other features and advantages of the present invention will become apparent in the following detailed description of the preferred embodiments with reference to the accompanying drawings, in which.

DETAILED DESCRIPTION OF THE PREFERRED EMBODIMENTS

Figure 1:
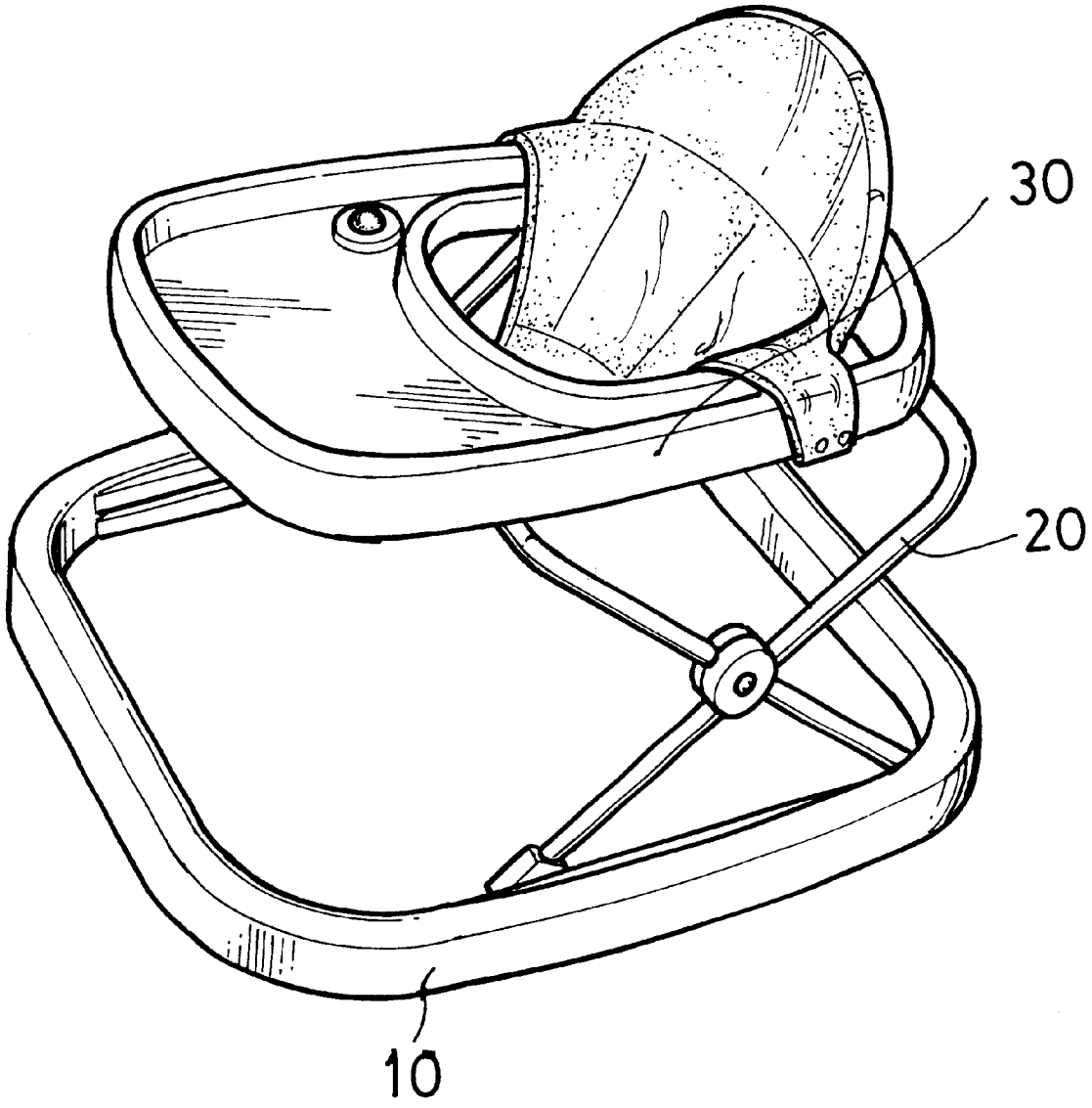
FIG. 1 (PRIOR ART)
FIG. 1 is a perspective view of a baby walker.
Figure 2:
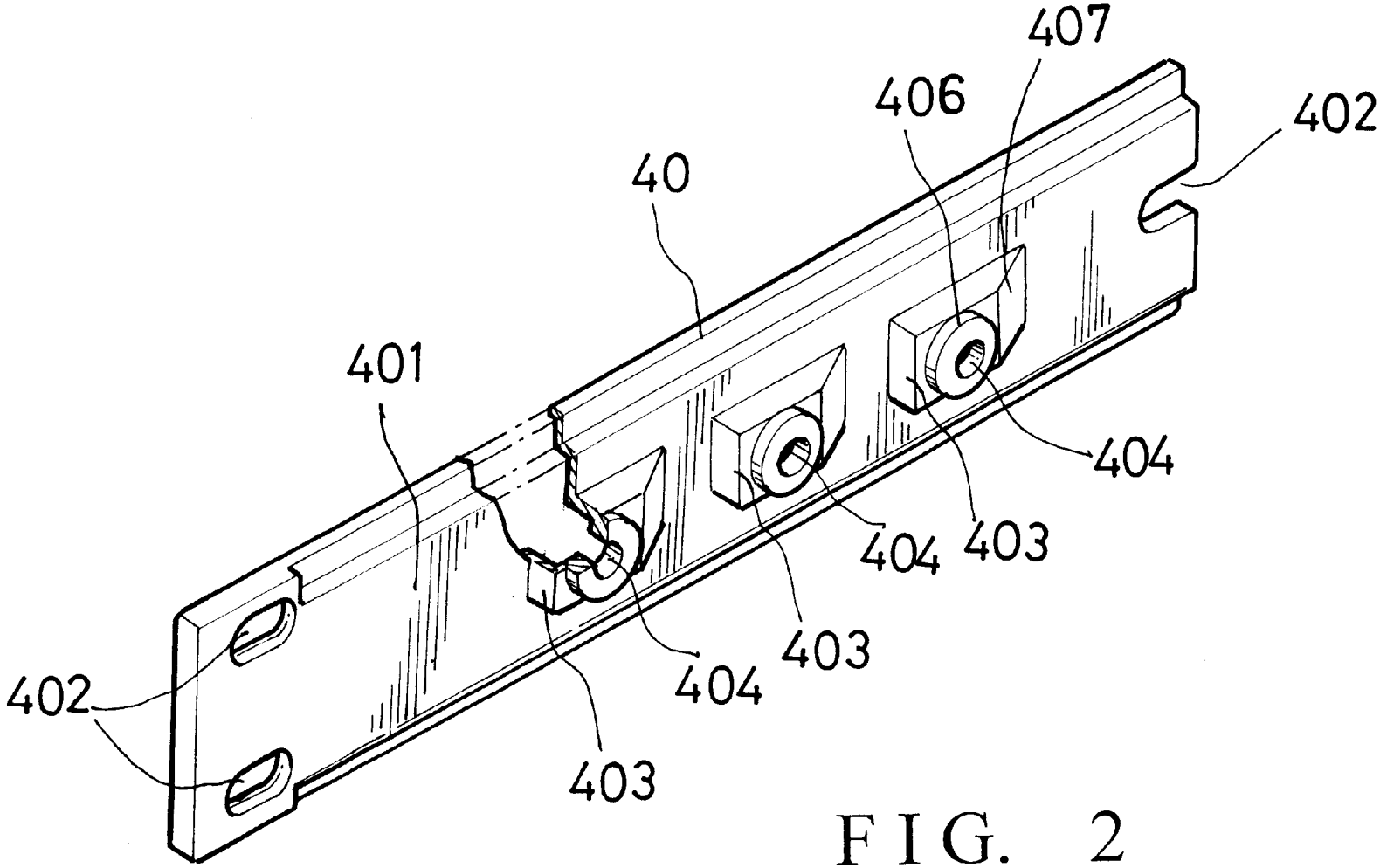
FIG. 2 (PRIOR ART)
FIG. 2 is a perspective view of a positioning board of a conventional height-adjusting device for a baby walker.
Figure 3:
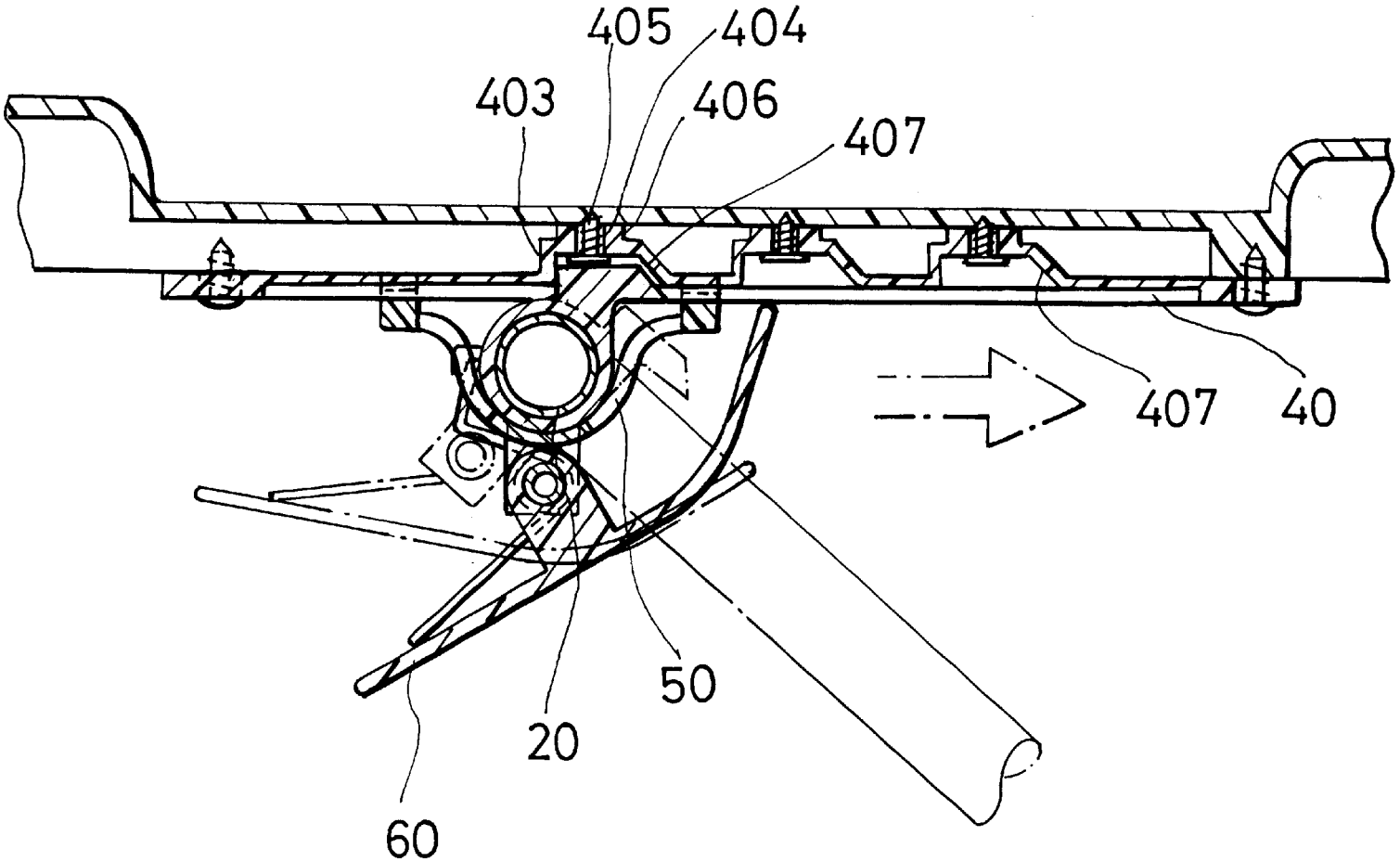
FIG. 3 (PRIOR ART)
FIG. 3 is a side sectional view of a conventional height-adjusting device being operated.
Figure 4:
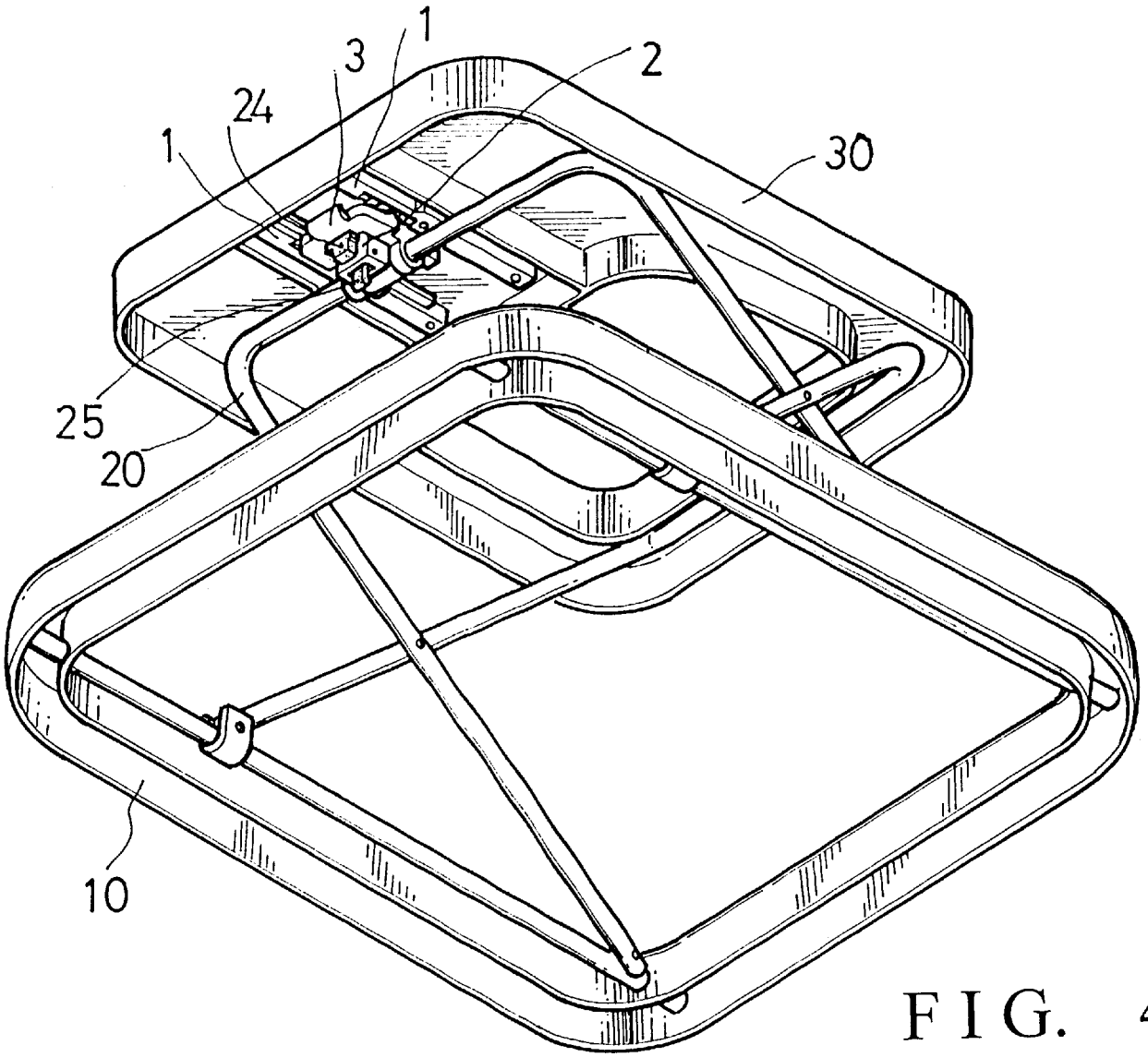
FIG. 4 is a perspective view of a baby walker being provided with the safety-control device of height adjustment in accordance with the present invention.

Referring to FIG. 4, a baby walker is composed by a base frame 10, a supporting skeleton 20 and an upper plate 30. A safety-control device of height adjustment in the present invention is disposed between the upper plate 30 and the supporting skeleton 20. The safety-control device of height adjustment is assembled by two opposite planks 1, a main body 2 and a pressing board 3. The opposite planks 1 are provided to secure to the bottom of the upper plate 30. One lateral rod of the supporting skeleton 20 successively penetrates through the pressing board 3 and the main body 2.

Figure 5:
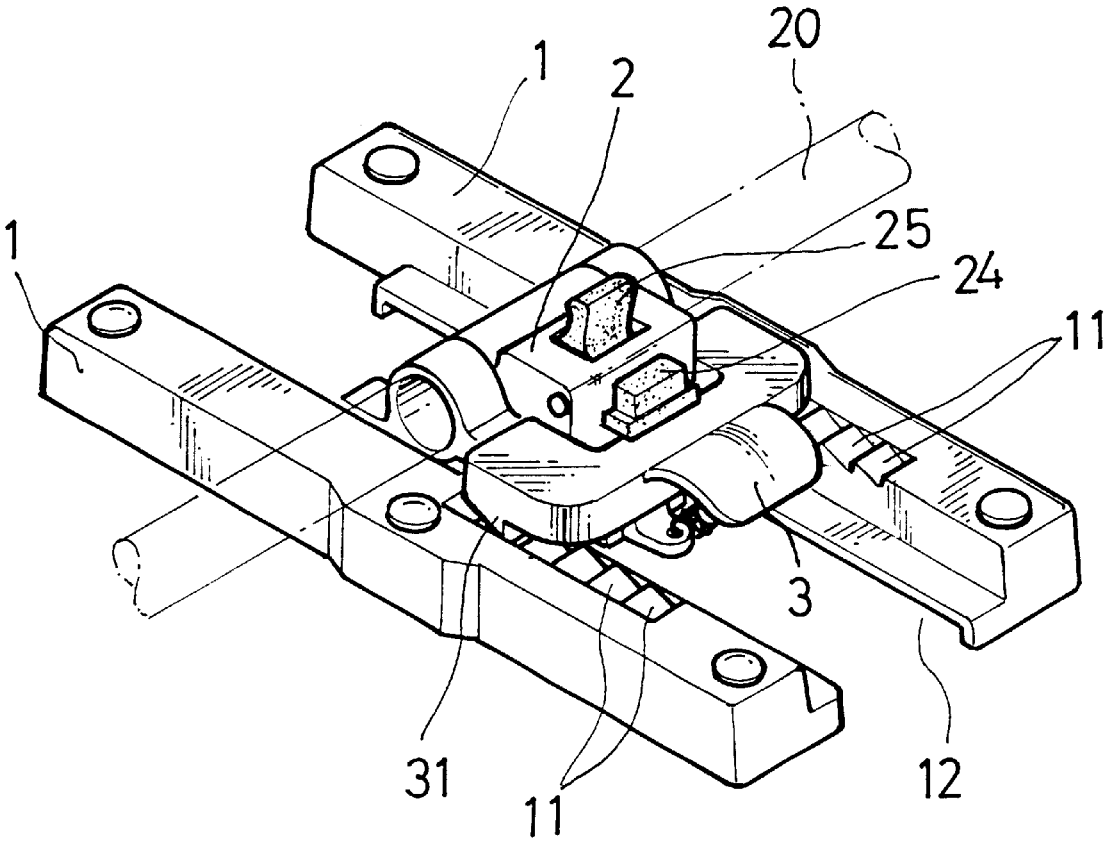
FIG. 5 is an assembled perspective view of the safety-control device of height adjustment in the present invention.
Figure 7:
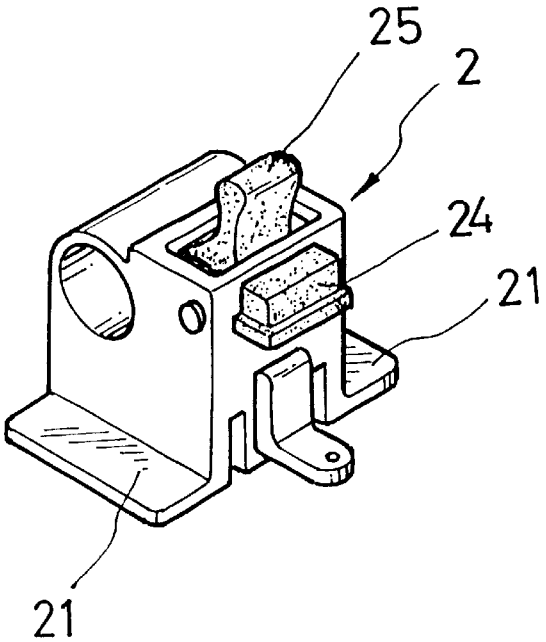
FIG. 7 is an assembled perspective view of the main body in the present invention.
Figure 6:
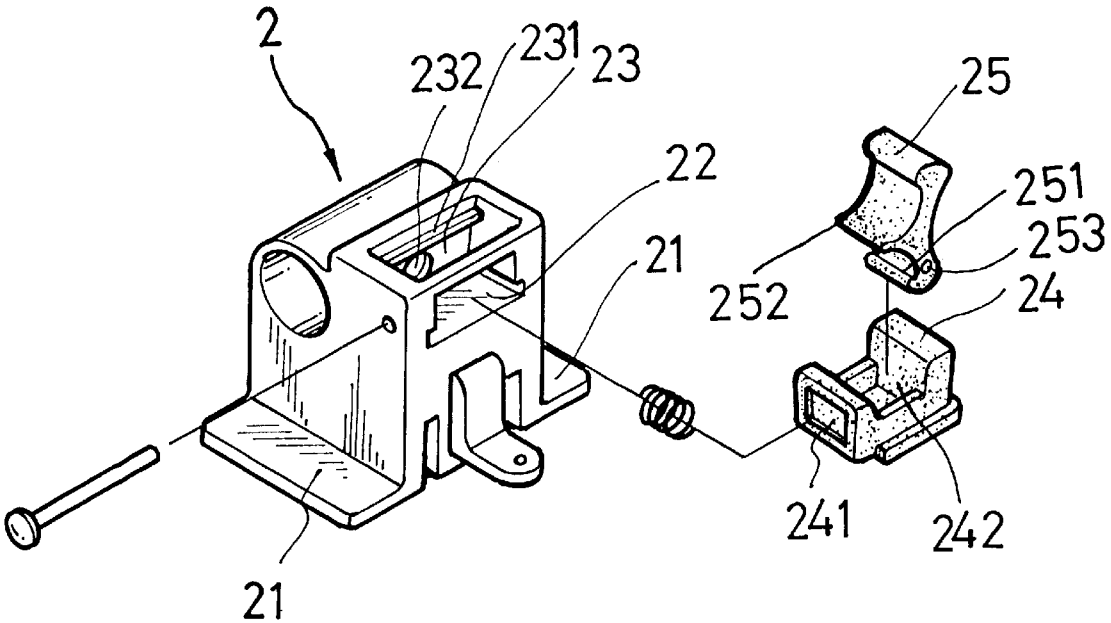
FIG. 6 is an exploded perspective view of the main body of the safety-control device of height adjustment in the present invention.

Referring to FIGS. 5,6 and 7, each of the two planks 1 is provided with several ratchets 11 and a groove 12. The main body 2 is provided with two flanged boards 21 on both sides so as to respectively protrude into the groove 12 of each plank 1. Thus, the main body 2 and the pressing board 3 can move straight together. The main body 2 and the pressing board 3 are connected because of being respectively hooked by one end of a spring. The pressing board 3 can move and restore to the original position because of being pivotally mounted on the lateral rod of the supporting skeleton 20 and the elasticity of the spring. A catch portion 31 on the bottom of the pressing board 3 is provided for catching and fixing any one of the ratchets 11 so as to adjust the height of the supporting skeleton 20 as well as the upper plate 30.

The characteristic improvement of the safety-control device in the present invention lies in the main body 2. Referring to FIGS. 6 and 7, the main body 2 is provided with two flanged boards 21 on both sides so as to respectively protrude into the groove 12 of each plank 1, and the main body 2 is provided with a lateral opening 22 in the front wall for receiving an elastic article and a stopping button 24. In the top of the main body 2 is provided with an upper room 23 for the elastic article, the stopping button 24 and an operating block 25 to be placed in. On the inner rear wall of the upper room 23 is provided with a flange 231 for the stopping flange 252 of the operating block 25 to rest on, and a hole 232 is provided in the inner rear wall of the upper room 23 for receiving one end of the elastic article. The stopping button 24 is provided with a hole 241 in the outer rear wall to receive one end of the elastic article and is provided with a hollow 242 for receiving the lower section of the operating block 25. On the bottom of the operating block 25 is provided with a catching flange 251, a long hole 253 is provided in the lower section of the operating block 25, and the stopping flange 252 is provided on the rear wall of the operating block 25. After the elastic article and the stopping button 24 being inserted into the lateral opening and secured in the upper room 23, the lower section of the operating block 25 is placed in the hollow 242 of the stopping button 24, and a fixing pin is used to penetrate through the passing holes of the main body 2 and the long hole 251 of the operating block 25 so as to make the operating block 25 be pivotally assembled with the main body 2. Therefore, the stopping button 24 can be moved out of the lateral opening 22 or withdrawn in the upper room 23 because of the operation of the operating block 25 and the elasticity of the elastic article.

Figure 8:
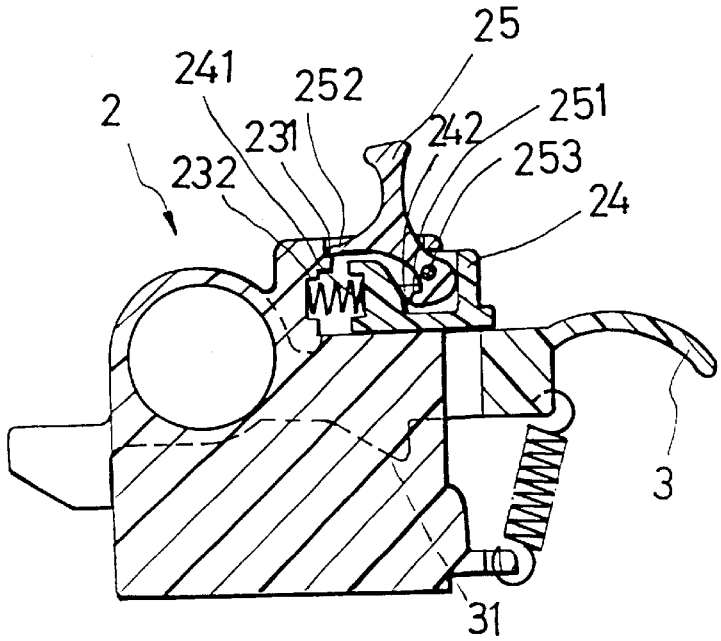
FIG. 8 is a side sectional view showing the pressing board being stopped by the stopping button in accordance with the present invention; and, FIG. 9 is a schematic side sectional view showing the safety-control device being operated by one hand in accordance with the present invention.
Figure 9:
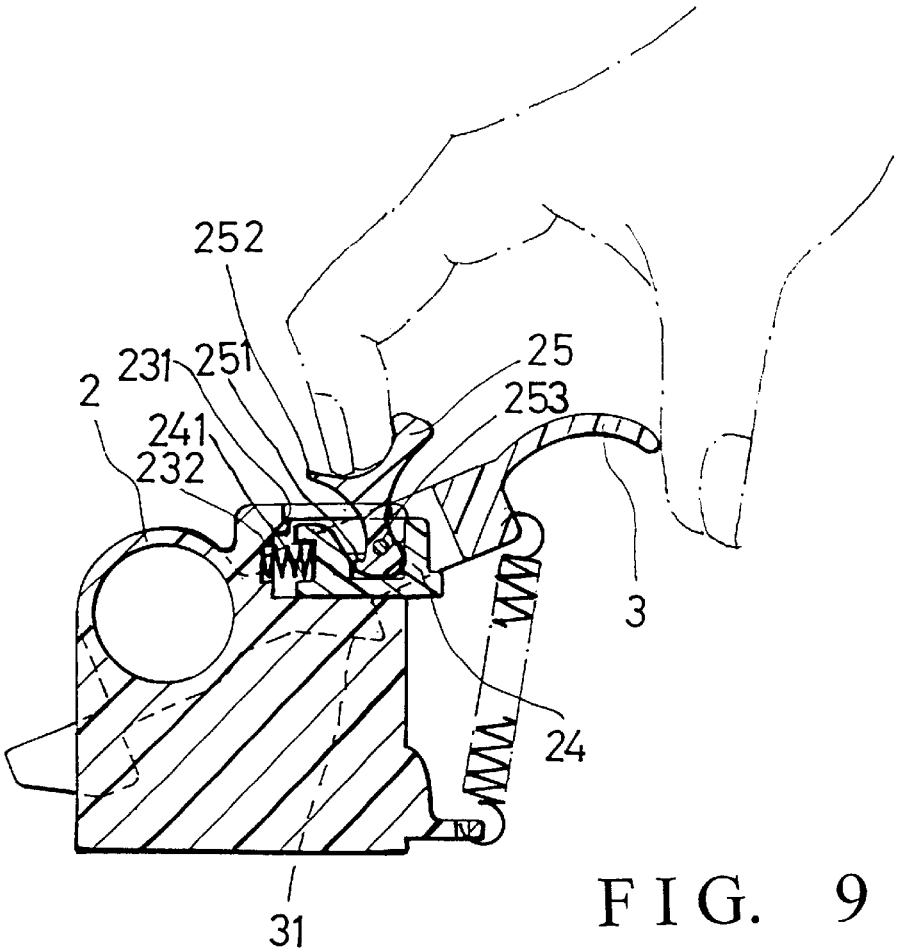

Referring to FIG. 8, when the operating block 25 is not operated (in released condition), the stopping button 24 can stop against the pressing board 3 so as to make the catch portion 31 of the pressing board 3 firmly catch one of the ratchets 11 and thus to fix the position of the upper plate 30. If it is necessary to adjust the height of the upper plate 30, referring to FIG. 9, the operating block 25 is operated by one finger to make the stopping button 24 be withdrawn inward for the pressing board 3 to be moved by another finger at the same time. After the pressing board 3 and the main body 2 as well as the supporting skeleton 20 being shifted together to choose one of the ratchets 11 for the catch portion 31 to catch and fix, the operating block 25 is released to let the stopping button 24 protrude outward by the elasticity of the elastic article to stop against the pressing board 3 again. Accordingly, the height of the upper plate 30 can be adjusted, and the position of the upper plate 30 is also firmly fixed.

Therefore, the device in the present invention is provided with a safety control because the operating block 25 and the pressing board 3 must be operated at the same time to adjust the height of the upper plate 30. Besides, the position of the upper plate 30 can be effectively and firmly fixed so as to prevent the upper plate 30 from rapidly falling down by the accident press of the pressing board 3.

While the preferred embodiments of the invention have been described above, it will be recognized and understood that various modifications may be made therein and the appended claims are intended to cover all such modifications which may fall within the spirit and scope of the invention.

What is claimed is:

1. A safety-control device of height adjustment for a baby walker comprising:

two opposite planks being provided to secure to the bottom of the upper plate of a baby walker, each of said opposite planks being provided with several ratchets and a groove;

a main body being provided with two flanged boards on both sides so as to respectively protrude into said groove of each plank, a lateral opening being provided in the front wall of said main body for receiving an elastic article and a stopping button, in the top of said main body being provided with an upper room for said elastic article and said stopping button and an operating block to be placed in, on the inner rear wall of said upper room being provided with a flange for the stopping flange of said operating block to rest on, in the inner rear wall of said upper room being provided with a hole for receiving one end of said elastic article, said stopping button being provided with a hollow for receiving the lower section of said operating block and being provided with a hole in the outer rear wall to receive one end of said elastic article, a catching flange being provided on the bottom of said operating block, in the lower section of said operating block being provided with a long hole, a stopping flange being provided on the rear wall of said operating block, after said elastic article and said stopping button being inserted into said lateral opening and secured in said upper room, the lower section of said operating block being placed in said hollow of said stopping button, a fixing pin being used to penetrate through passing holes of said main body and said long hole of said operating block so as to make said operating block pivotally assembled with said main body, and said stopping button able to be moved out of said lateral opening or withdrawn in said upper room because of the operation of said operating block and the elasticity of said elastic article; and, a pressing board being connected with said main body by being respectively hooked by one end of a spring, said pressing board and said main body being successively penetrated through by one lateral rod of the supporting skeleton of a baby walker, said pressing board able to move and restore to the original position by being pivotally mounted on said lateral rod of the supporting skeleton and the elasticity of said spring, a catch portion on the bottom of said pressing board being provided for catching and fixing any one of said ratchets, when said operating block is operated by one finger to make said stopping button withdraw inward, said pressing board is moved by another finger at the same time as said pressing board and said main body as well as the supporting skeleton being shifted together to choose one of said ratchets on said two planks for said catch portion to catch and fix, when said operating block being released, said stopping button protruding outward by the elasticity of said elastic article to stop against said pressing board again.

* * * * *